US006464092B1

(12) United States Patent
Kortman et al.

(10) Patent No.: US 6,464,092 B1
(45) Date of Patent: Oct. 15, 2002

(54) INDUSTRIAL COMPONENT RACK ASSEMBLY

(75) Inventors: Calvin J. Kortman; Mark A. Kortman; Joyce E. Kortman, all of Holland, MI (US)

(73) Assignee: Production Assembly Service, Inc., Holland, MI (US)

( * ) Notice: Subject to any disclaimer, the term of this patent is extended or adjusted under 35 U.S.C. 154(b) by 0 days.

(21) Appl. No.: 09/532,437

(22) Filed: Mar. 23, 2000

(51) Int. Cl.[7] ..... A47B 57/00
(52) U.S. Cl. ..... 211/194; 211/162
(58) Field of Search ..... 211/194, 175, 211/162, 191, 192, 151, 94.02, 94.01, 46, 169, 169.1, 126.15, 170–172, 204, 59.2; 312/117, 119, 122, 128, 131, 132, 334.23, 334.7, 313, 317.1, 330.1, 334.32, 348.3, 348.5

(56) References Cited

U.S. PATENT DOCUMENTS 1,414,858 A * 5/1922 Brown
1,421,515 A * 7/1922 McKnight
1,480,537 A * 1/1924 Heller
1,691,621 A * 11/1928 Young
3,275,394 A * 9/1966 Massinger
3,338,423 A * 8/1967 Wellman, Jr. ..... 211/194
3,465,891 A * 9/1969 De Rose
3,586,410 A * 6/1971 Barrow ..... 312/294
3,630,387 A * 12/1971 Wehner ..... 211/151
3,729,242 A * 4/1973 Barney ..... 312/107
3,912,086 A * 10/1975 de Bruyn ..... 211/162
3,999,663 A * 12/1976 Walter et al. ..... 211/46
4,008,807 A * 2/1977 Phillips ..... 211/153
4,191,436 A * 3/1980 Cherry ..... 312/293
4,249,663 A * 2/1981 Hewlett ..... 211/84.01
4,403,701 A * 9/1983 Corcoran ..... 211/189
4,527,694 A * 7/1985 Bolt et al. ..... 211/162
4,585,127 A * 4/1986 Benedict ..... 211/94.01
4,653,818 A * 3/1987 DeBruyn ..... 312/246
4,907,706 A * 3/1990 Henderson ..... 211/162
4,988,006 A * 1/1991 Lundin ..... 211/45
4,998,630 A * 3/1991 Schwartz ..... 211/162
5,031,782 A * 7/1991 Minervini ..... 211/162
5,154,305 A * 10/1992 Whitney ..... 211/162
5,255,798 A * 10/1993 Aaldenberg et al. ..... 211/46
5,358,126 A * 10/1994 Jones et al. ..... 211/189
5,437,379 A * 8/1995 Wolf et al. ..... 211/13.1
5,452,811 A * 9/1995 Taravella et al. ..... 211/186
5,590,940 A * 1/1997 Richard ..... 312/287
5,924,577 A * 7/1999 Gessert ..... 211/41.1
6,022,033 A * 2/2000 Landesman et al. ..... 211/94.02
6,039,473 A * 3/2000 Bond ..... 383/5
6,073,786 A * 6/2000 McCorkle, Jr. ..... 211/187
6,220,462 B1 * 4/2001 Brockman et al. ..... 211/131.1
6,273,470 B1 * 8/2001 Bullock ..... 281/29

* cited by examiner

*Primary Examiner*—Daniel P. Stodola
*Assistant Examiner*—Jennifer E. Novosad
(74) *Attorney, Agent, or Firm*—Van Dyke, Gardner, Linn & Burkhart, LLP

(57) ABSTRACT

A rack assembly for holding industrial components, such as vehicle components, including class A components includes a frame and a carrier assembly which is suspended from the frame. The carrier assembly is adapted to individually support a plurality of components in a spaced vertical or horizontal arrangement and is slidably mounted to the frame such that the carrier assembly is movable between a stored position within the frame and an extended position whereby the vehicle components are easily accessible for retrieval. Preferably, the frame includes a plurality of the carrier assemblies with each carrier assembly including a plurality of holders arranged at least on one side of the carrier assembly. In preferred form, the holders comprise pockets which are arranged in a plurality of rows and columns, with the pockets being configured from a flexible substrate to gently cradle the respective components.

15 Claims, 5 Drawing Sheets

INDUSTRIAL COMPONENT RACK ASSEMBLY

TECHNICAL FIELD AND BACKGROUND OF THE INVENTION

The present invention generally relates to a rack assembly for holding components and, more particular, to a rack assembly for holding industrial components, such as vehicle components, including class A components, furniture components, computer components or the like, in a manner to preserve the integrity of each component.

When assembling products, such as a vehicle, a computer, furniture, or the like, the assembly line workers need quick access to the pre-assembled parts or components that are to be installed in or on the product so that the assembly line flow is unimpeded by the flow of parts. In order to have a large supply of these pre-assembled parts, smaller parts are typically stored en masse in totes which are positioned adjacent the assembly line for easy access by the line worker. Totes are typically plastic open top containers which are mounted on rollers so the totes can be quickly and easily moved to the assembly line to supply the parts and moved from the assembly line to replenish the supply in order to maintain a generally constant supply of parts.

Some pre-assembled parts, such as vehicle class A components, however, are vulnerable to damage and are not well suited for conventional tote storage, in which parts are stored en masse. For example, class A components must be free of scratches, nicks or mars when installed into a vehicle. In conventional tote storage, contact between the parts is inevitable absent some sort of barrier and such contact can and often results in damage. In an attempt to resolve this problem, some components are individually and/or separately wrapped before placement into a tote. When wrapped, the components do not directly contact the other components which substantially reduces, if not eliminates, scratching, nicking or marring. However, hand wrapping each individual component is time consuming and, as a result, expensive. In addition, when a part is pulled from a tote, the line worker must first lift the part, which in some cases may exceed the maximum recommended weight for lifting, unwrap the part, and then discard the wrapping and dividers. On a part-by-part basis, the additional weight and handling and preparation time may seem insignificant but on a volume basis, the additional weight, wrapping preparation time, and additional handling time significantly increases the stress on the assembly line workers and the assembly time.

Consequently, there is a need for a storage device that will provide a cost efficient method for holding a plurality of pre-assembled industrial components, such as computer components, furniture components, vehicle components, including class A components, while providing easy access to each individual component for installation. In addition, there is a need for a storage device that will provide the above advantages and, further, will protect the individual components from contact with other components and, therefore, protect the components for damage all in a manner that will permit a constant flow of parts and will reduce the handling time and, further, will eliminate excessive lifting.

SUMMARY OF THE INVENTION

According to the present invention, a rack assembly for holding a plurality of industrial components is provided that holds the components in such a manner that the components are readily available for installation in an assembly line and, further, are protected from damage. In preferred form, the rack individually supports each components to essentially eliminate contact between the components and, furthermore, supports the components in a carrier assembly which permits easy access to all of the components.

In one form of the invention, a rack assembly for holding industrial components includes a frame and a carrier assembly. The frame includes at least one upper support and is adapted to rest on a generally horizontal support surface. The carrier assembly is suspended from the upper support and is adapted to support a plurality of industrial components in a spaced, vertical arrangement. The carrier assembly is slidably mounted to the upper support and is movable between a stored position within the frame and an extended position whereby the industrial components are easily accessible for retrieval.

In one aspect, the rack assembly includes a plurality of the carrier assemblies. In other aspects, the carrier assembly includes a plurality of holders for holding the industrial components. For example, the carrier assembly may include opposed sides with the holders being arranged on at least one side. Preferably, the holders are arranged on both sides to increase the capacity of the carrier assembly. Preferably the holders comprise pockets, for example pockets arranged in rows and columns. Furthermore, the pockets are preferably configured from a flexible substrate to gently cradle the respective industrial components. For example, the flexible substrate may comprise a fabric material.

In yet other aspects, the frame includes a plurality of generally vertically arranged members and a plurality of generally horizontally arranged members which interconnect the vertically arranged members to form the frame, with the upper support being defined by a plurality of the horizontally arranged members.

In yet further aspects, the carrier assembly is slidably mounted to the upper support by an extendable member. The extendable member, for example, may comprise an extendable rail. Preferably, the frame includes a pair of upper horizontal members, with the extendable rail including a fixed portion, which is mounted between the pair of upper horizontal members, and an extendable portion which is movable along the fixed portion. The carrier assembly is mounted to the extendable portion so that the carrier assembly can be moved with respect to the fixed portion and the frame from its stored position to its extended position.

In another form of the invention, a rack assembly for holding industrial components includes a frame and a carrier assembly which is suspended between an upper support and a lower support of the frame. The carrier assembly is adapted to support a plurality of industrial components in a generally vertical arrangement and is slidably mounted to the upper support and lower support. The carrier assembly is movable between a stored position within the frame and an extended position whereby the industrial components are easily accessible for retrieval.

In one aspect, the carrier assembly preferably includes a plurality of holders for individually holding the industrial components. Preferably, the rack assembly includes a plurality of the carrier assemblies with each of the carrier assemblies being movably mounted to the upper support and lower support. In preferred form, each of the carrier assemblies is independently movably mounted to the upper support and the lower support, so that each carrier assembly may be selectively moved between its stored position and its extended position.

In further aspects, the holders comprise pockets, with each of the pockets including an upper access opening. In this manner, the industrial components can be inserted into and retrieved from the pockets through the upper access opening. In preferred form, the pockets are configured from a flexible substrate, such as fabric material, to gently cradle the industrial components.

In yet another form of the invention, the rack assembly for holding vehicle components includes a frame and a carrier assembly suspended between the sides of the frame. The carrier assembly includes a plurality of holders for individually supporting a respective plurality of industrial components in a generally horizontal, spaced arrangement and is slidably mounted to the sides of the frame. The carrier assembly is movable between a stored position within the frame and an extended position whereby the industrial components are easily accessible for retrieval from the holders.

These and other advantages, purposes and objects will be more apparent from a review of the drawings and the description which follows.

DETAILED DESCRIPTION OF THE PREFERRED EMBODIMENTS

Figure 1:
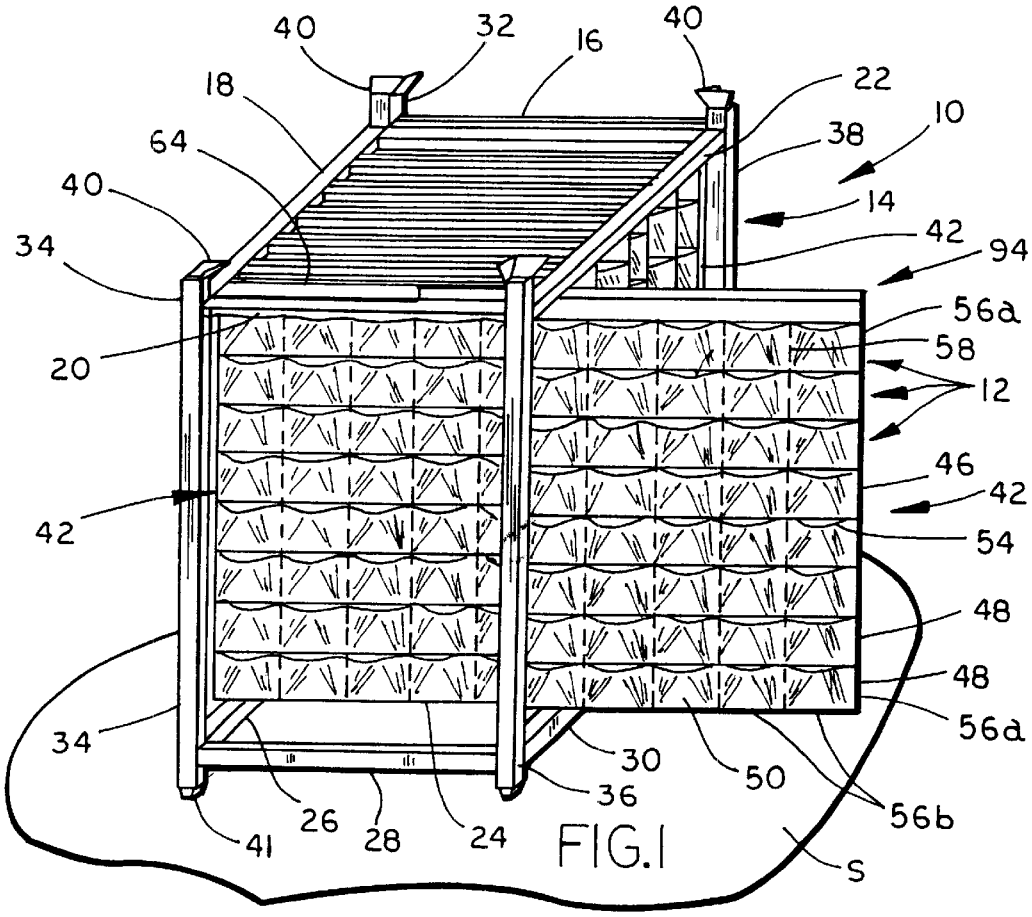
FIG. 1 is a perspective view of a rack assembly of the present invention.

Referring to FIG. 1, the numeral 10 generally designates a rack assembly of the present invention. Rack assembly 10 includes a plurality of holders 12 for holding a plurality of industrial components which are vulnerable to damage. Holders 12 are positioned and arranged on a frame 14 such that a group of holders 12 can be moved between a storage position within the frame, where the components are protected by the frame itself, and an extended position to provide access to the individual components positioned in the holders. Holders 12 are preferably arranged to individually support the industrial components to protect the components from contact with each other or contact with other hard surfaces. In addition, holders 12 are preferably arranged or assembled so that the components are retained in the respective holders under the force of gravity. As will be appreciated from the description which follows, each holder 12 gently cradles the components and protects the components from contact with any hard surfaces. Rack assembly 10 of the present invention is particularly suitable for holding and supporting a plurality of vehicle components in a vehicle assembly line and, more particularly, suitable for holding and supporting class A vehicle components which are required to be free of scratches or mars of any sort before installation into a vehicle.

As best seen in FIG. 1, frame 14 includes a plurality of upper frame members 16, 18, 20, and 22, for example angle members or other structural members, which are arranged to provide an upper support 23 for holders 12, as will be more fully described below, and a plurality of lower frame members 24, 26, 28, and 30 which are interconnected with upper frame members 16, 18, 20, and 22 by a plurality of vertical frame members 32, 34, 36, and 38. The individual frame members may be secured together by welding or fasteners or the like. It can be appreciated that upper support member 23 may be provided by various combinations of structural members, including for example by a single structural member, such as a panel or plate.

Vertical frame members 32, 34, 36, and 38 preferably include rollers or wheels 41 mounted to their respective lower ends to movably support frame 14 on a generally planar support surface S, such as a floor of a manufacturing facility. Frame 14 is preferably a relatively rigid frame and includes optional guide support members 40 mounted to the upper ends of vertical frame members 32, 34, 36, and 38 which permit a similar frame to be stacked on top of frame 14 for transport or storage.

Suspended from upper support 23, which in the illustrated embodiment is formed by upper frame members 16, 18, 20, and 22, are a plurality of carrier assemblies 42. Each carrier assembly 42 is preferably slidably mounted to upper support 23 by an extendable member 44, such as an extendable rail, so that each carrier assembly 42 may be selectively moved between a stored position within frame 14 and an extended position wherein the respective carrier assembly is extended or cantilevered from frame 14 by the extendable rail to provide easy access to components supported in carrier assembly 42, which is more fully described below. Each carrier assembly 42 includes a backing member 46 and a plurality of compartments 48 which form holders 12. Compartments 48 in the illustrated embodiment comprise pockets 50 that are formed from a flexible substrate 51 which is mounted to backing member 46 in a manner to form a recess 52 in which a respective component may be positioned for storage. Each pocket 50 further includes an access opening 54 provided at an upper portion of the respective pocket 50 which permits a respective component to be insert into and removed from the pocket 50. In this manner, pockets 50 gently cradle the components in a spaced arrangement, with each component being separately or individually supported by a respective pocket and held in place by gravity. It should be understood that in some applications, more than one component may be supported in a single pocket.

Figure 2:
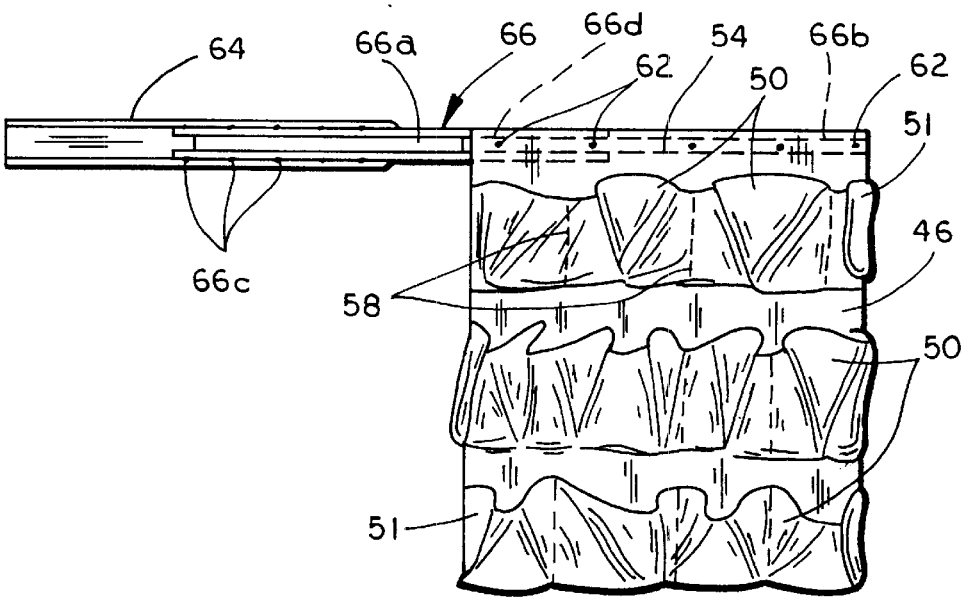
FIG. 2 is an elevation view of a carrier assembly of the rack of FIG. 1.

Referring to FIGS. 1 and 2, holders 12 are preferably arranged to support the respective components in a vertical arrangement. For example, holders 12 are preferably arranged in a plurality of rows 56*a* and columns 56*b*. In preferred form, flexible substrate 51 is secured or adhered to backing member 46, for example, by stitching 58, snaps, fasteners, adhesive or the like. For example, each row 56*a* of pockets 50 may be formed by a single flexible substrate which is sewn at regular or irregular intervals to the backing member 46 to form either a row of pockets having equal widths or a row of pockets have varying widths. Alternately, each pocket 50 may be formed by a separate substrate. In addition, a single flexible substrate may be secured or adhered to backing member 46, with the pockets formed between stitched sections of the substrate and the access openings being formed by a cut into the substrate. Preferably, the access openings face in a generally upward direction so that the components will not easily fall out of their respective pockets. It should be understood, that the size and shape of the respective pockets 50 formed by the flexible substrate may be varied as desired or as needed to accommodate the various sizes and shapes of components. In addition, the pockets may be pleated to increase the volume of pockets.

Referring to FIG. 2, backing member 46 is secured to extendable member 44 by a plurality of fasteners 62. As best seen in FIG. 2, extendable member 44 includes a fixed portion 64, which is mounted between upper frame members 18 and 22, and an extendable portion 66. Extendable portion 66 in the illustrated embodiment includes a pair of nesting or telescoping rails 66*a* and 66*b*. Rail 66*a* is slidably mounted to fixed portion 64 on a plurality of bearing members or rollers 66*c*, which provide a smooth gliding action for rail 66*a* as it is extended from fixed portion 64. Rail 66*b* is slidably mounted to rail 66*a* on a plurality of bearing or rollers 66*d* and, therefore, extends outwardly relative to both the fixed portion and rail 66*a*. Each carrier assembly 42 is mounted to a respective rail 66*b* by fasteners 62 such that when carrier assembly 42 is extended from its stored position, rail 66*a* will initially slide or guide along bearings 66*c* to move relative to frame 14, followed by rail 66*b* sliding or guiding along rail 66*a* to move relative to frame 14 and rail 66*a* in a similar manner to a conventional drawer rail. In this manner, extendable member 44 provides a smooth sliding or guiding action while providing a fairly rigid support of the respective carrier assembly 42 even when the carrier assembly is fully extended from the frame. It should be understood that other extendable rails or extendable devices may be used.

As previously described, frame 14 preferably supports a plurality of carrier assemblies 42 which are preferably individually suspended from upper support 23 by a respective extendable member. It should be understood that the number of carrier assemblies is a function of the size of the components and the size of the frame. Therefore, it should be understood that the number of carrier assemblies may be increased or decreased as desired.

Figure 3:
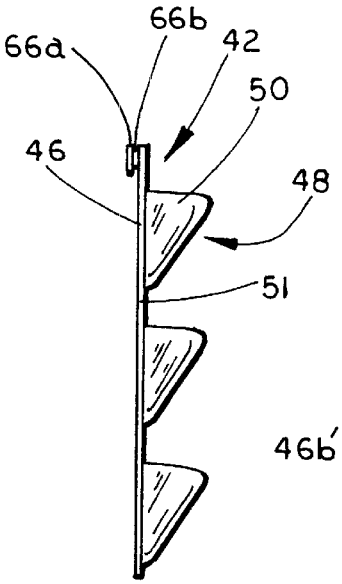
FIG. 3 is a side elevation view of the carrier assembly of FIG. 2.
Figure 4:
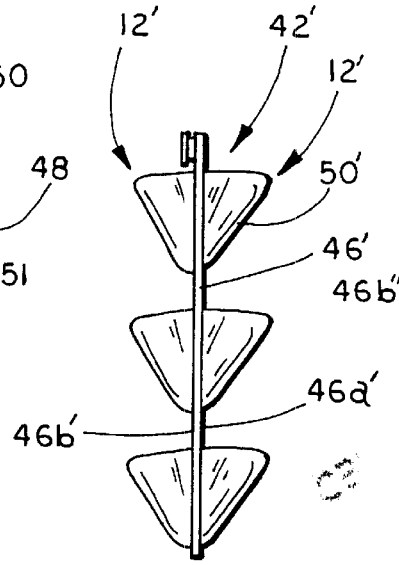
FIG. 4 is a side elevation view similar to FIG. 3 illustrating a second embodiment of the carrier assembly.

Referring to FIG. 3, a second embodiment of carrier assembly 42' is illustrated. Carrier assembly 42' is of similar construction to carrier assembly 42 and includes a backing member 46' and a plurality of holders 12'. Reference is made to the first embodiment for further details of how holders 12' may be formed or assembled. In the illustrated embodiment, holders 12' are provided on both sides 46*a*' and 46*b*' of backing member 46' to increase the capacity of each individual carrier assembly. It should be understood that the holders on one side of the backing member 46' may be formed in one arrangement, while the holders on the other side or opposed side of backing member 46' may be placed in a second arrangement.

Figure 5:
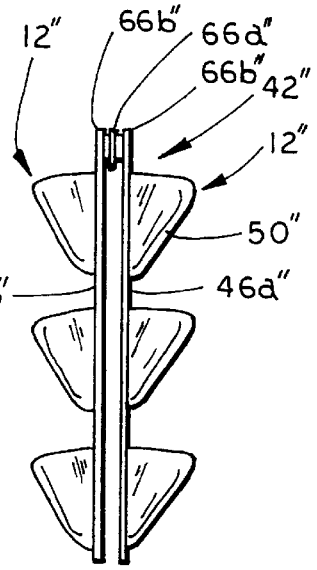
FIG. 5 is a side elevation view similar to FIG. 3 illustrating a third embodiment of a carrier assembly of the present invention.

Referring to FIG. 5, a third embodiment of a carrier assembly 42" is illustrated. Carrier assembly 42" includes a pair of backing members 46*a*" and 46*b*" with each backing member 46*a*" and 46*b*" including a plurality of holders 12". In addition, each backing member 46*a*" and 46*b*" is respectively suspended from and mounted on an extendable nesting rail 66*b*". Rails 66*b*" are slidably mounted to a common extendable rail 66*a*", which in turn is slidably mounted to a fixed rail portion similar to the previous embodiments. In this manner, when carrier assembly 42" is extended, at least one of the rails 66*b*" may be held in a partially extended position while the other rail 66*b*" may be fully extended to provide full access to the carrier assembly supported on the fully extended rail. As a result, the weight of both carrier assemblies can be more evenly distributed which results in a more stable arrangement.

Figure 6:
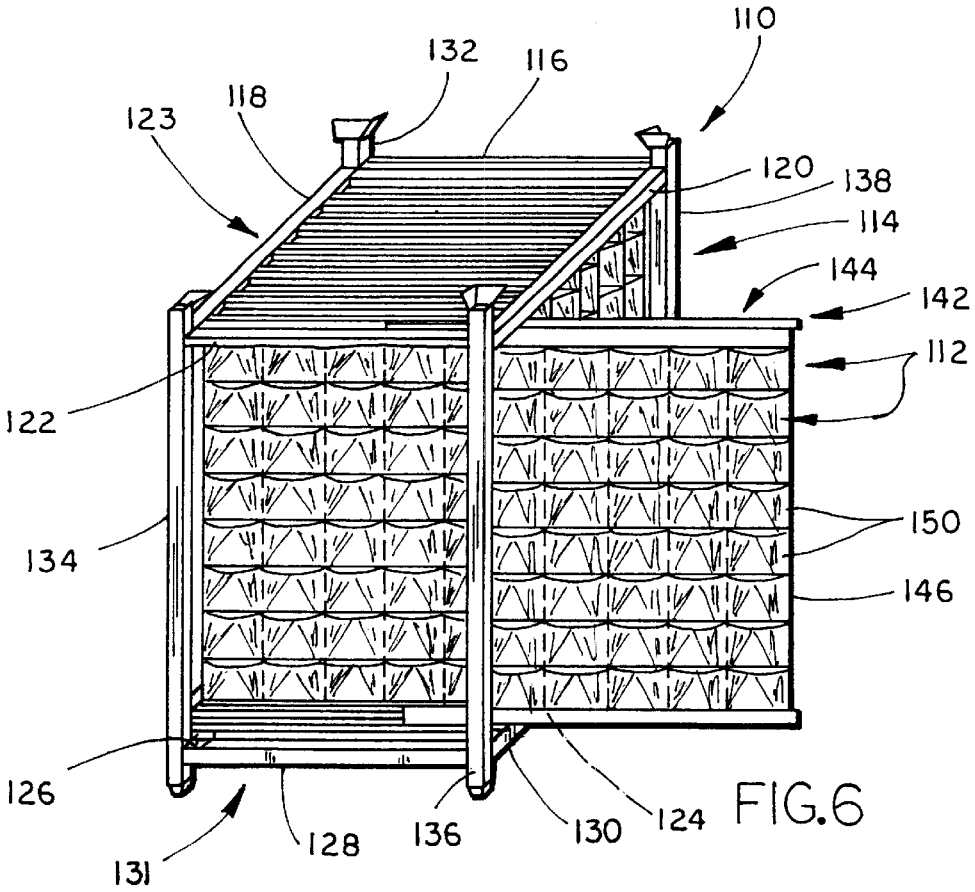
FIG. 6 is a perspective view of a second embodiment of the rack assembly of the present invention.

Referring to FIG. 6, a second embodiment of rack assembly 110 is illustrated. Rack 110 includes a frame 114, which is of similar construction to rack 14, and plurality of holders 112. Rack 114 includes upper frame members 116, 118, 120, and 122, which form an upper support 123, and lower frame members 124, 126, 128, and 130, which form a lower support 131. Extending between the upper and lower frame members are a plurality of generally vertical column frame members 132, 134, 136, and 138, which interconnect with the upper and lower frame members to form frame 114. Rack assembly 110 further includes a plurality of carrier assemblies 142, which are slidably mounted to frame 114 between upper support 123 and lower support 131.

Similar to the first embodiment, each carrier assembly 142 includes a backing member 146 on which a plurality of pockets 150 is provided to form holders 112. Each backing member 146 is mounted to upper and lower extendable members 144*a* and 144*b* so that carrier assemblies 142 can be moved between their respective stored positions and their extended positions to provide access to the components stored in the respective carrier assemblies.

In the illustrated embodiment, extendable member 144*a* is mounted between upper frame members 118 and 122, while lower extendable member 144*b* is mounted between lower frame members 126 and 130, such that backing member 146 is supported at both its upper and lower edges to provide a more stable configuration for carrier assembly 142. Carrier 142 may be of similar construction to carrier member 42, carrier assembly 42' or carrier member 42" and, therefore, reference is made to the previous embodiments for further details.

Figure 7:
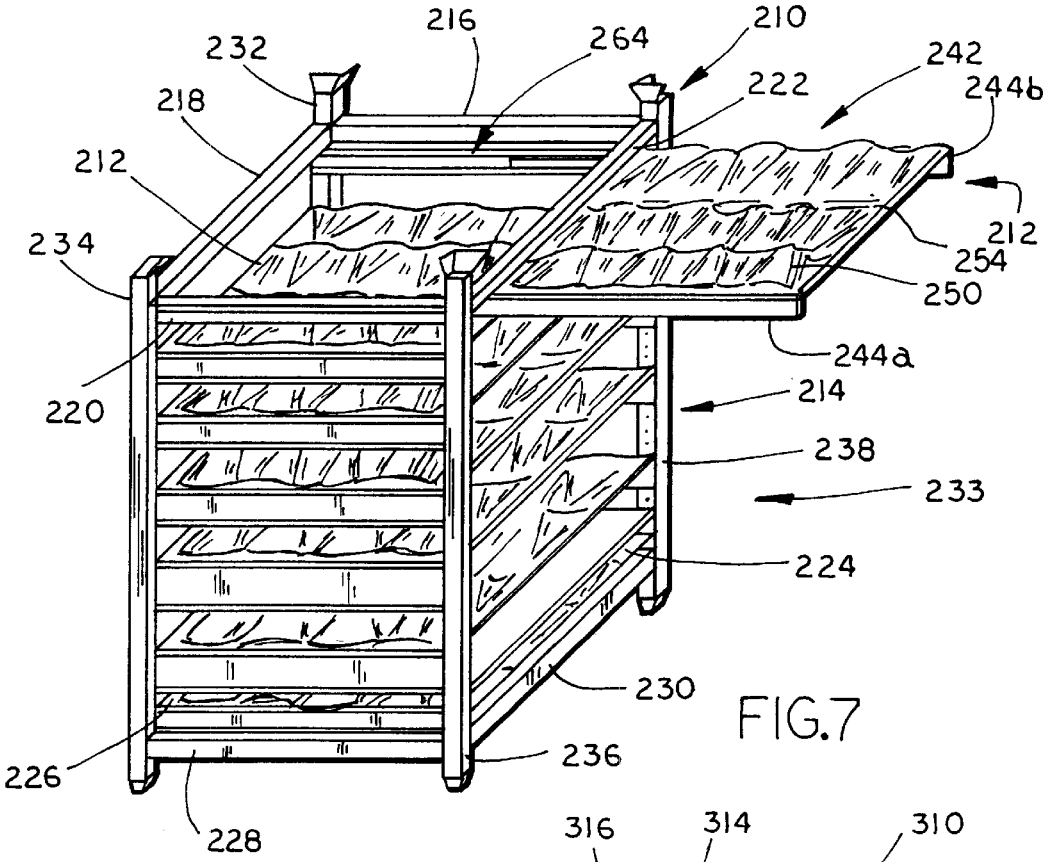
FIG. 7 is a perspective view of a third embodiment of the rack assembly of the present invention.

Referring to FIG. 7, a third embodiment 210 of the rack assembly of the present invention is illustrated. Rack assembly 210 includes a frame 214 which is defined by a plurality of upper frame members 216, 218, 220, and 222, lower frame members 224, 226, 228, and 230, and a plurality of vertically arranged frame members 232, 234, 236, and 238, similar to the first and second embodiments, with members 232, 218, 234, and 226 defining one side 231 and members 236, 222, 238, and 230 defining a second opposed side 233 of frame 214. As noted in reference to the first embodiment, frame 214 can be assembled or formed using numerous structural components.

Rack assembly 210 includes a plurality of carrier assemblies 242, with each carrier assembly 242 including a respective plurality of holders 212 defined by pockets 250, which provide for individual support for a respective plurality of industrial components. For further details of carrier assembly 242, reference is made to the previous embodiments. In the illustrated embodiment, carrier members 242 are slidably mounted and suspended between opposed sides 231, 233 of frame 214 such that each carrier assembly 242 supports and holds their respective plurality of components in a generally horizontal, spaced arrangement.

Similar to the previous embodiment, carrier assembly 242 is mounted to frame 214 by first and second extendable members 244*a* and 244*b* such that each respective carrier assembly 242 may be individually moved between a retracted position within frame and an extended position from frame 214 to provide access to the individual components supported in the respective holders 212 of each individual carrier assembly 242. In the illustrated embodiment, extendable members 244*a* and 244*b* are mounted to sides 231 and 233 between vertical members 232 and 238 and 234 and 236.

In preferred form, the access openings 254 of each respective pocket 252 faces in an orientation generally orthogonal to the direction of movement of the carrier assembly 242 such that when each carrier member 242 is moved between its retracted position and its extended position, the respective vehicle components will remain positioned in their respective pockets. However, it should be understood that the orientation of the respective pockets may be changed, for example, such that the access openings face toward the direction of extension or retraction of respective carrier assemblies 242.

Figure 8:
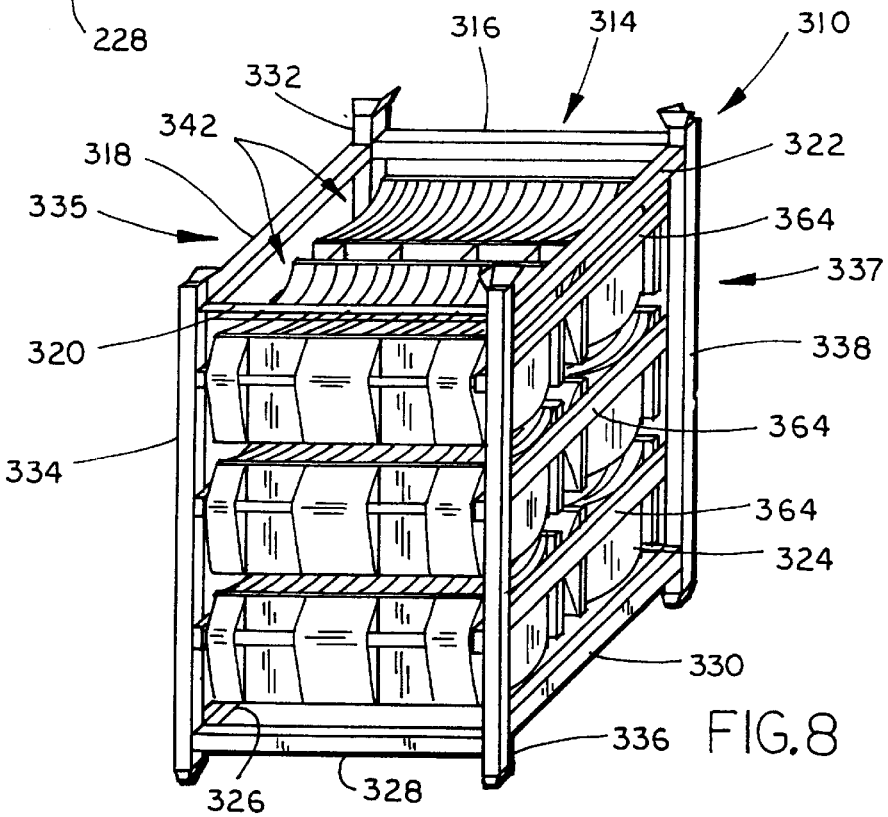
FIG. 8 is a perspective view of a fourth embodiment of the rack assembly of the present invention.

Referring to FIG. 8, a fourth embodiment 310 of the rack assembly of the present invention is illustrated. Rack assembly 310 includes a frame 314 which is defined by a plurality of interconnected frame members similar to the previous embodiments. Frame 314 includes a first set of horizontally arranged frame members 316, 318, 320, and 322 and a second set of horizontally arranged frame members 324, 326, 328, and 330 which are vertically spaced from the first set and are respectively interconnected by vertical frame members 332, 334, 336, and 338 similar to the previous embodiments. Frame members 332, 338 and 334, 336 define opposed sides 335 and 337 of frame 314 for mounting carrier assemblies 342. Suspended between sides 335 and 337 are a plurality of carrier assemblies 342, which are stacked within frame 314 in a generally vertical arrangement as shown in FIG. 8.

Figure 9:
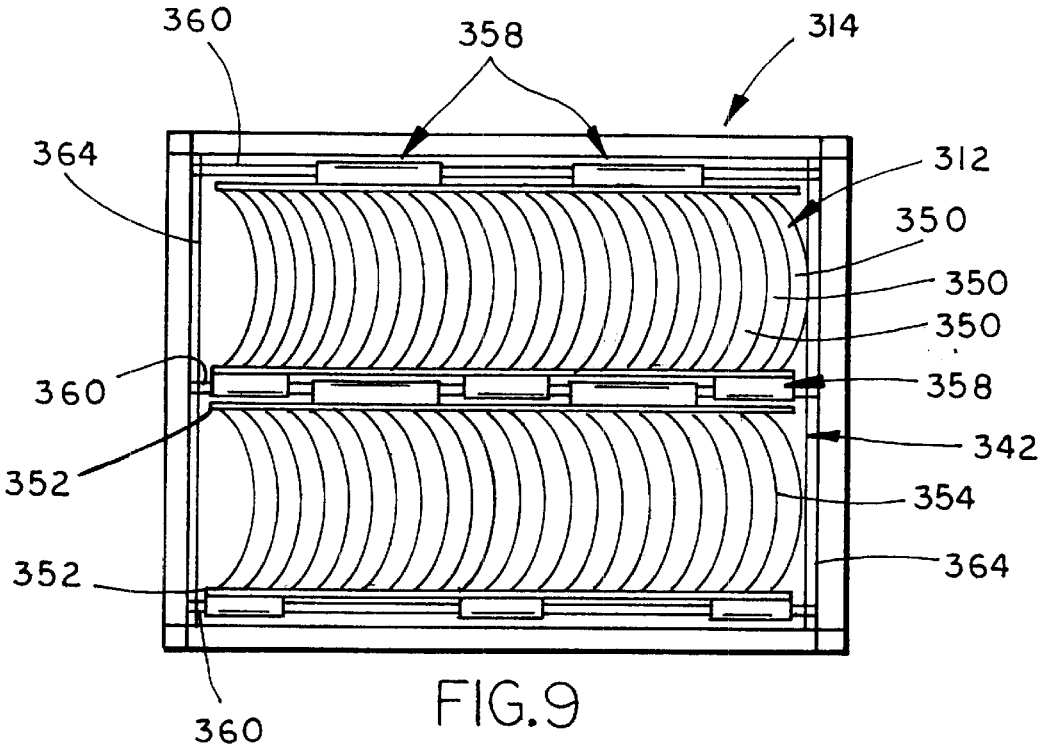
FIG. 9 is an enlarged perspective view of a carrier member of FIG. 8.
Figure 10:
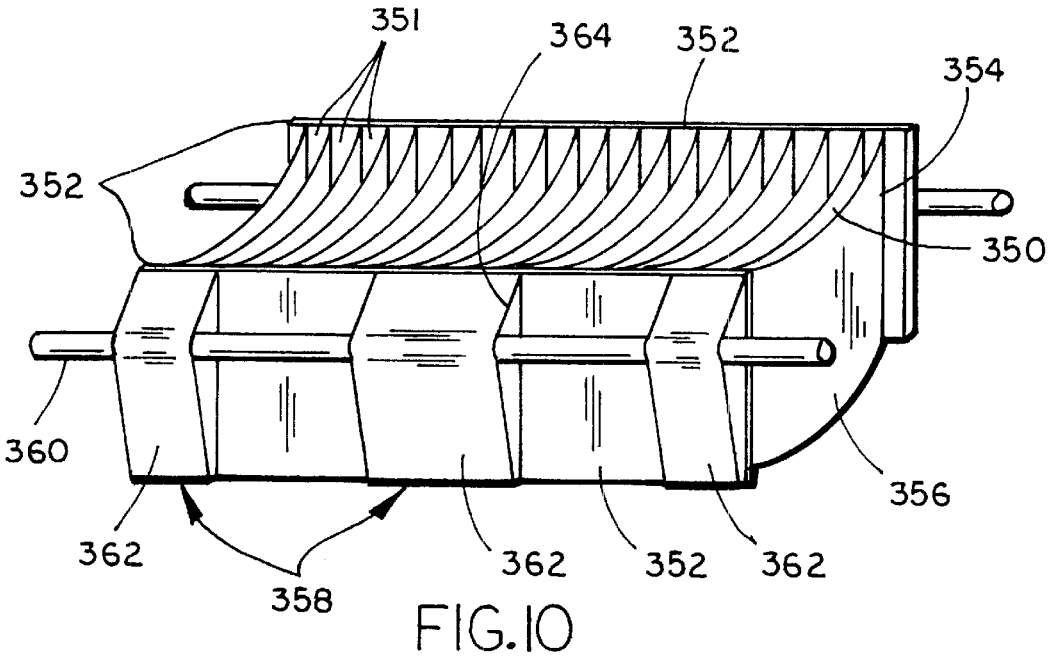
FIG. 10 is an enlarged perspective view of a second embodiment of the carrier assembly of FIG. 8.

As best seen in FIG. 9, each carrier assembly 342 includes a plurality of holders 312 defined by pockets 350, which provide for support for a plurality of industrial components. Preferably, each pocket 350 is sized to individually support a respective industrial component so that each of the components are physically separated from adjacent components to avoid contact between the components. Each carrier assembly 342 includes opposed side members or side walls 352 and a plurality of interconnecting webs 354 which are mounted to side members 352 at the respective ends and, further, are interconnected at their lower edges 356 to the adjacent webs. In this manner, webs 354 form pockets 350 and provide pockets which extend between side members 352. Webs 354 preferably comprise a flexible material, such as fabric or the like as described in reference to the pockets of the previous embodiments. Each side wall 352 preferably comprises a substantially rigid plate member formed from a plastic, wood, metal, or the like and may further comprise a corrugated material, such as corrugated plastic. Preferably, webs 354 are mounted to side walls 352, for example by stitching, stapling, or an adhesive. When carrier assemblies 342 are positioned in frame 314, pockets 350 are positioned such that their respective openings 351 face upwardly and, thus, provide for easy access to the respective components within pockets 350. Mounted to sides 352 are a plurality of spaced mounting members 358 which receive an arm 360, such as a rod, angle member, or the like for mounting carrier assembly 342 to frame 314, as will be more fully described below. In preferred form, mounting members 358 comprise flexible loops 362 formed, for example from a fabric, including a strap material, which is mounted to upper and lower portions of side walls 352. In this manner, when arm 360 is extended through the respective loops 362 and carrier assembly 342 is mounted to frame 314, arm 360 will rest in the upper corner 364 of the respective loops 362.

Figure 8A:
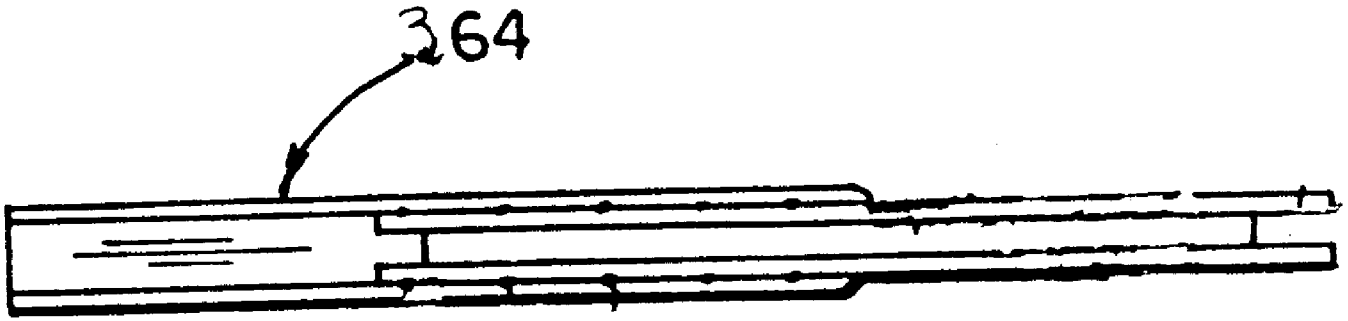
FIG. 8A is an enlarged elevation view of one embodiment of the rail of FIG. 8.

As best seen in FIG. 9, mounting members 358 are arranged in a staggered fashion so that adjacent carrier assemblies may be mounted on a common mounting arm 360 to frame 314. In this manner, the mounting members 358 form a nesting arrangement such that the carrier assembly 354 may be closely positioned within frame 314. Mounting members 360 are preferably slidably mounted to frame 314 on a pair of opposed rails 364 such that, carrier assemblies 342 may be moved between their retracted position within frame 314 to an extended position to provide access to their respective parts held by carrier assemblies 342. Rails 364 preferably comprise nesting rails similar to the rails described in reference to the previous embodiments (for example see FIG. 8A).

Referring again to FIG. 8, carrier assemblies 342 may be stacked in a plurality of rows, such that each row may be individually moved from its respective retracted position within frame 314 to an extended position for access to the individual components within the respective carrier assemblies. Though assembly 310 is illustrated with three rows, it should be understood that the number of rows may be increased or decreased depending on the size of frame 314 and the size of carrier assemblies 342.

Referring to FIG. 11, a fifth embodiment 310' of the rack assembly of the present invention is illustrated. Rack assembly 310' is similar to rack assembly 310 but instead includes three sets of carrier assemblies 342' in each row. It should be understood, that rack assemblies 310 and 310' may include adjustable or movable rails 364 to permit adjustment within the individual frame 314 of the position of carrier assemblies 342, 342'. In this manner, a single frame 314 may be used to support one or more rows of carrier assemblies and, further, to support multiple rows, with the rails 364 being adjusted to accommodate the specific arrangement of carrier assemblies 342.

Backing members 46, 46', 46", 146, 246, 346 may comprise a relatively rigid substrate, such as a plastic panel, a corrugated plastic, corrugated cardboard, wood, or even a metal sheet or panel. Alternately, backing members 46, 46', 46", 146, 246, 346 may comprise a flexible substrate, such as a vinyl, a fabric, such as canvas, a composite fabric/plastic or the like. When a flexible backing member is provided, at least the upper edges and lower edges may be reinforced by stays, such as an elongate plate or the like, to provide reinforcement and further to provide a relatively rigid mounting surface for fasteners 62. Depending on the substrate material, the backing member may be weighted to keep the backing member generally aligned along a vertical axis. Each respective pocket 50, 50', 50", 150, 250, or 350 is preferably formed from a flexible material, such as a vinyl material, leather, a fabric sheet, such as a canvas material, or foam. It should be understood, that the materials described for the backing member and holders are exemplary only and are not intended to limit the scope of the invention.

Alternately, carrier assembly 42, 42', 42", 142, 242, 342, or 342' may be molded as a unitary member, for example a molded plastic member or the like, or may include molded sub-assemblies that are assembled, for example, by stitching, an adhesive, snaps, fasteners, or the like. Preferably, as described above, the holders are formed or at least assembled from material, which will not induce scratching, or marring of the vehicle components. For example, molded holders may be lined with a flexible or soft material. In addition, each holder can be tailored to suit the configuration of each type of component to be supported in the rack assembly. For example, one carrier assembly may have holders shaped and sized to hold vehicle light assembly lenses, while another carrier assembly may have holders sized and shaped to hold interior trim components. As would be understood, the combinations are too numerous to mention.

It can be appreciated that the industrial rack assembly of the present invention provides an improved means for storing a plurality of industrial components in a manner to preserve the integrity of the components while still providing quick and easy access to the components for assembly and also providing an assembly that is easy to maneuver and stack for storage.

The above description is considered to be that of the preferred embodiments only. Modification of the invention will occur to those skilled in the art and to those who make or use the invention. Therefore, it is understood that the embodiments shown in the drawings and described above are merely for illustrative purposes only and are intended to limit the scope of the invention, which is defined in the following claims as interpreted according to the principles of patent law including the Doctrine of Equivalents.

We claim:

1. A rack assembly for holding industrial components, said rack assembly comprising:

a frame having a pair of opposed spaced apart generally vertical sides, and said vertical sides being adapted to rest on a generally horizontal support surface; and a plurality of carrier assemblies suspended between said vertical sides in a side-by-side relationship, each of said carrier assemblies having opposed generally vertical side walls and a plurality of flexible webs extending between said side walls to form a row of holders for supporting industrial components therein in a horizontal arrangement and each of said carrier assemblies being slidably mounted to each of said sides by an extendable member, each holder having a closed bottom, closed sides, and an open top, and said carrier assemblies being movable between a stored position within said frame and an extended position whereby the industrial components are easily accessible for retrieval from said holders.

2. The rack assembly for holding industrial components according to claim 1, wherein said holders comprise pockets.

3. The rack assembly for holding industrial components according to claim 2, wherein said side walls comprise substantially rigid side walls.

4. The rack assembly for holding industrial components according to claim 2, wherein said pockets comprise a fabric material.

5. The rack assembly for holding industrial components according to claim 1, wherein said side wall comprise corrugated panels.

6. The rack assembly for holding industrial components according to claim 1, wherein said extendable member comprises an extendable rail.

7. The rack assembly for holding industrial components according to claim 6, wherein said extendable rail including a fixed portion and an extendable portion, said fixed portion being mounted to a respective side, and each of said carrier assemblies being mounted to a respective extendable portion of a respective extendable rail.

8. The rack assembly for holding industrial components according to claim 1, wherein each of said sides includes a plurality of generally vertically arranged members and a plurality of generally horizontally arranged members, said horizontally arranged members interconnecting said vertically arranged members to form said frame.

9. A rack assembly for holding industrial components, said rack assembly comprising:

a frame having a pair of opposed spaced apart generally vertical sides and a pair of extendable members, and said sides being adapted to rest on a generally horizontal support surface; and at least one carrier assembly suspended between said sides, said carrier assembly having a pair of spaced apart generally vertical side walls, a plurality of pockets extending and being mounted between said side walls for supporting industrial components in a spaced horizontal arrangement, and a pair of arms extending between said vertical sides of said frame; said side walls suspended between said arms, and said arms being slidably mounted between said sides of said frame, each of said pockets comprising a flexible substrate and having an open top, closed sides, and a closed bottom, said at least one carrier assembly being slidably mounted to said vertical sides by said extendable members wherein said at least one carrier assembly is movable between a stored position within said frame and an extended position whereby the industrial components are accessible for retrieval from said pockets through said open tops of said pockets.

10. The rack assembly according to claim 9, wherein said flexible substrate comprises a fabric material.

11. The rack assembly according to claim 9, wherein said plurality of pockets are arranged in a horizontal arrangement.

12. The rack assembly according to clam 11, wherein said frame includes a plurality of generally vertically arranged members and a plurality of generally horizontally arranged members interconnecting said vertically arranged members to form said frame, said extendable members being mounted to said generally vertically arranged members.

13. The rack assembly according to claim 12, wherein said extendable members comprise nested, telescoping rails.

14. The rack assembly according to claim 9, wherein said side walls comprise substantially rigid side walls.

15. The rack assembly according to claim 14, wherein said side walls comprise corrugated plastic panels.

* * * * *

UNITED STATES PATENT AND TRADEMARK OFFICE

CERTIFICATE OF CORRECTION

PATENT NO. : 6,464,092 B1 
DATED : October 15, 2002
INVENTOR(S) : Calvin J. Kortman, Mark A. Kortman and Joyce E. Kortman It is certified that error appears in the above-identified patent and that said Letters Patent is hereby corrected as shown below:

Column 9,
Line 51, “wall” should be -- walls --

Column 10,
Line 25, “;” should be -- , --

Signed and Sealed this

Twenty-sixth Day of October, 2004

JON W. DUDAS
*Director of the United States Patent and Trademark Office*